United States Patent [19]

Daino

[11] Patent Number: 4,648,162

[45] Date of Patent: Mar. 10, 1987

[54] STAINED GLASS CREMATION URN WITH FOAM AND PAPER LINER

[76] Inventor: Grant O. Daino, P.O. Box 1827, Cape Coral, Fla. 33910

[21] Appl. No.: 490,047

[22] Filed: Apr. 29, 1983

[51] Int. Cl.[4] ..... A61G 17/08; B44C 5/08

[52] U.S. Cl. ..... 27/1; 27/8; 27/19; 428/38; D99/5

[58] Field of Search ..... 27/1, 7, 8, 19; 220/410; 312/114; 428/38; D99/5

[56] References Cited

U.S. PATENT DOCUMENTS

| | | | |
|---|---|---|---|
| D. 201,132 | 5/1965 | Lawrence | D99/5 |
| D. 268,623 | 4/1983 | Dercks et al. | D99/5 |
| 1,211,684 | 1/1917 | de Camp | 27/19 X |
| 1,365,634 | 1/1921 | Tyree | 27/8 |
| 2,009,724 | 7/1935 | Bircher | 27/1 |
| 2,023,260 | 12/1935 | Beers et al. | 312/114 |
| 2,040,497 | 5/1936 | Porter | 312/114 |
| 2,513,951 | 7/1950 | McClellen | 27/1 |
| 3,285,461 | 11/1966 | Santelli | 220/410 |
| 3,488,818 | 1/1970 | Orr | 27/19 |
| 3,676,920 | 7/1972 | Pilditch | 428/38 |
| 3,697,147 | 10/1972 | Schulte | 312/114 |
| 4,252,847 | 2/1981 | DelGrande | 428/38 |
| 4,324,026 | 4/1982 | Craft | 27/1 |

*Primary Examiner*—Robert E. Bagwill
*Assistant Examiner*—Terrence L. B. Brown
*Attorney, Agent, or Firm*—Alfred E. Wilson

[57] ABSTRACT

This invention utilizes the beauty and durability of stained glass combined with innovative assembly techniques to provide a cremation urn that is pleasing in appearance, light in weight, rugged in construction, and moisture and dust resistant to meet all of the criteria that have been established for cremation urns. On the base a layer of foam on the inside of the urn further seals the urn and prevents rattling of the cremation remains. Also, a paper line prevents the remains from being visible.

1 Claim, 6 Drawing Figures

STAINED GLASS CREMATION URN WITH FOAM AND PAPER LINER

BACKGROUND OF THE INVENTION

Throughout the ages efforts have been made to reduce the quantities of land that are needed for use as cemetaries required for the disposal of the remains of mortal life. Cremation has been increasing in acceptance and in use, however, the disposal or preservation of the ashes resulting from cremation has long since posed serious problems. Many kinds of containers have been utilized to store the ashen remains, but none has been universally acceptable. Many efforts have been made to devise a storage container that would meet the varied needs and desires of the relatives and friends of deceased parties.

FIELD OF THE INVENTION

Throughout the ages efforts have been made to provide suitable receptacles for the crematory remains, and literally many shapes and forms of repositories have been devised and used.

This invention is directed to the provision of a line of crematory urns that embody a wide range of decorative decor to meet the asthetic desires of relatives and friends of the deceased and which can be used in a wide range of locations to meet the widely divergent needs for crematory urns. By resorting to the use of stained glass, and to the use of new and improved methods of assembling and harmonizing various sections of stained glass a wide range of crematory urns has evolved to meet the widely divergent needs therefor.

DESCRIPTION OF THE PRIOR ART

Heretofore virtually every conceivable type of container has been used as a crematory urn. The most widely used in recent years has been the glass cannister type which have proven to be very ineffective because they were not dust and moisture proof, and they were objectionable from an aesthetic point of view because they exposed the crematory remains to view to an undesirable degree and they were too drab and suggestive.

SUMMARY OF THE INVENTION

The primary purpose of this invention is to devise a wide range of crematory urns wherein the beauty of variously colored and shaped sections of stained glass can be combined in unique ways to provide a wide range of crematory urns to meet the needs and desires of a wide range of relatives and friends.

An object of this invention resides in the provision of a line of light weight, stained glass crematory urns wherein variously colored segments of glass are combined to provide asethetically acceptable units assembled in accordance with unique methods to provide a wide range of sturdy moisture and dust proof urns wherein the ashen remains are obscured from view.

BRIEF DESCRIPTION OF THE DRAWINGS

In the drawings wherein similar reference characters refer to similar parts throughout the several views.

DESCRIPTION OF THE PREFERRED EMBODIMENT

Figure 1:
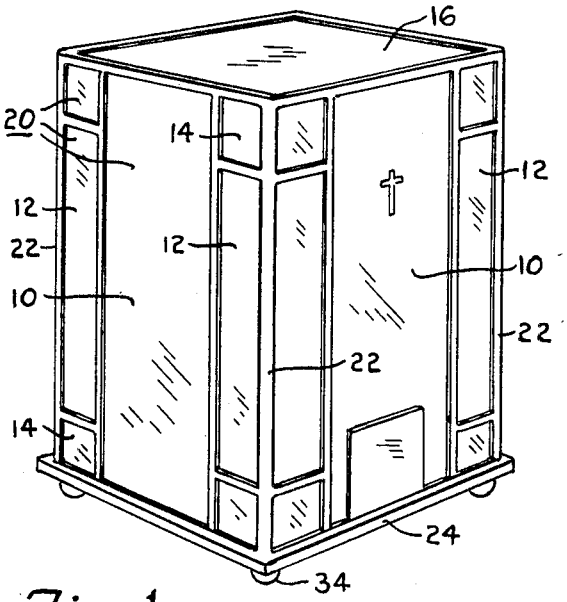
FIG. 1 is a perspective view of a crematory urn embodying the present invention.

The cremation urn is formed of a plurality of pieces of stained glass of harmonizing colors selected to provide an appealing combination of colors. The stained glass is generally available in large sheets 4'×4' and it is cut into a desired number of pieces such for example as 16 pieces of varying sizes and colors to be used in the formation of an urn.

Referring now to the drawings a typical cremation urn is formed by cutting various pieces of stained glass, such as the segments 10, 12 and 14 which cooperate to form one side panel of the urn. The other side panels can employ similarly sized and shaped segments of the same or harmonizing colors or the other panels can have differently shaped segments and can employ different colors. Another piece of stained glass 16 of approximate size is provided to form the top of the urn.

When the pieces of stained glass have been selected to form one of the side panels, a strip of copper foil is applied to all of the edges of the pieces of stained glass 20 completely cover the edge and to extend along the sides of the pieces 20 of the stained glass by a small amount, such for example as approximately ⅛". The pieces of stained glass 20 with the copper foil in place thereon are then laid on a flat surface with a small spacing between them whereupon hot or molten lead is flowed over the joint. The hot lead is attracted by the copper foil so that a straight surface of lead beading following the contours of the copper foil is provided along the junctures of the glass pieces 20. This lead beading is shaped by hand to fill the space between the edges of the pieces of glass and it embodies a slight build-up along the edges which provides a smooth well rounded joint therebetween which lends a pleasing artistic appearance.

The lead filling the space between the pieces of stained glass provides in effect a framework 22 formed of the lead which extends along both sides of the glass to securely clamp it in place and to provide a moisture and dust proof joint.

Figure 5:
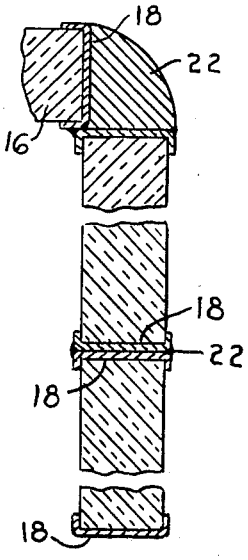
FIG. 5 is a fragmentary sectional view of one of the corners of the embodiment of FIG. 1.

When the flat side walls have thus been formed two of them are successively assembled in a jig to join the side walls in the manner heretofore described. It will be noted that a well rounded built up section 22 of lead is provided to form the corners as illustrated in FIGS. 5 and 6.

When the sides are thus formed the top 16 is assembled with the sides and it has the copper foil covering the edges and extending down over the sides of the top 16 by an amount ranging for example approximately ⅛". The top of the pieces of stained glass 10, and 14 and any others that extend to the top of the urn are treated with the copper foil.

When all is in readiness with the appropriate copper foil in place on the top and on the sides, and the top 16 assembled with the sides forming the upper portion of the urn on a suitable jig, then hot lead is applied to the space between the edges of the glass. The lead flows in seeking contact with the copper foil, and it is hand worked to provide a smooth well rounded layer of lead extending over the edges of all adjacently positioned stained glass pieces. The formed lead increases in thickness between the adjacently positioned pieces of glass to securely hold the stained glass parts in assembled relation.

Figure 3:
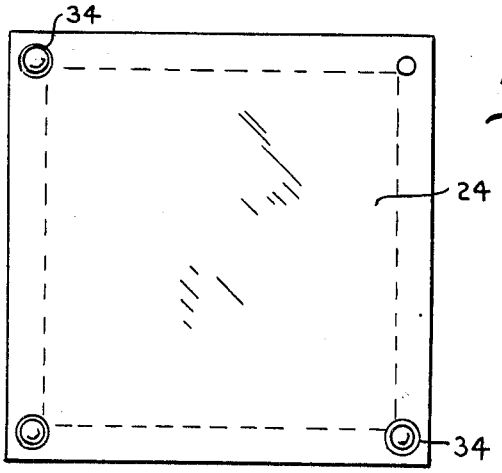
FIG. 3 is a bottom plan view of the urn illustrated in FIG. 1.
Figure 4:
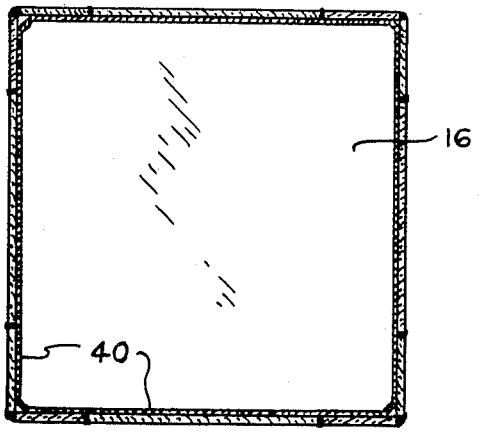
FIG. 4 is a sectional view taken substantially on the line 4—4 of FIG. 2 looking in the direction of the arrows.
Figure 6:
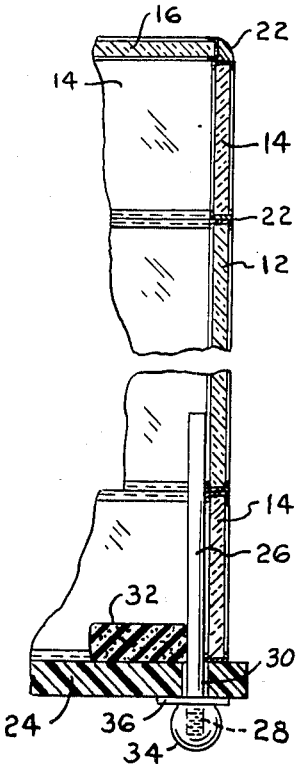
FIG. 6 is a sectional view taken substantially on the 6—6 of FIG. 2, looking in the direction of the arrows.

Referring now to FIGS. 3 and 6 it will be noted that a base or bottom 24 preferably about $\frac{1}{4}''$ in thickness is formed of an acrylic, preferably a black or white or a copper colored acrylic although any color can be used.

When the upper portion of the urn is formed, threaded rods 26 as shown in FIG. 6 are soldered or otherwise secured to the seams of each corner. The lower or threaded end 28 of the rods 26 extend below the surface of the urn to project through holes 30 formed in the base or bottom member 24. A ball 32 preferably formed of brass is drilled and threaded to thread onto the threaded ends 28 of the rods 26 projecting through the holes 30 in the base or bottom 24 to hold the base 24 securely on the urn.

The base 24 has approximately $\frac{1}{4}''$ of foam 32 secured on the upper surface of the base 24 to seal the space between the base and the upper portions of the urn secured thereto. The foam material 32 on the upper surface of the base 24 acts as a cushion to prevent any rattling of the cremation remains placed in the urn, and functions to seal the space within the urn. Also a paper board liner 40 is secured in place along the inner edges of the urn to prevent the cremation remains placed in the urn from being visible through the stained glass sides.

The cremation urn can of course be formed with varied patterns of stained glass segments 20, for example one side can be a single piece of solid stained glass, or any desired configuration of stained glass segments may be employed.

Figure 2:
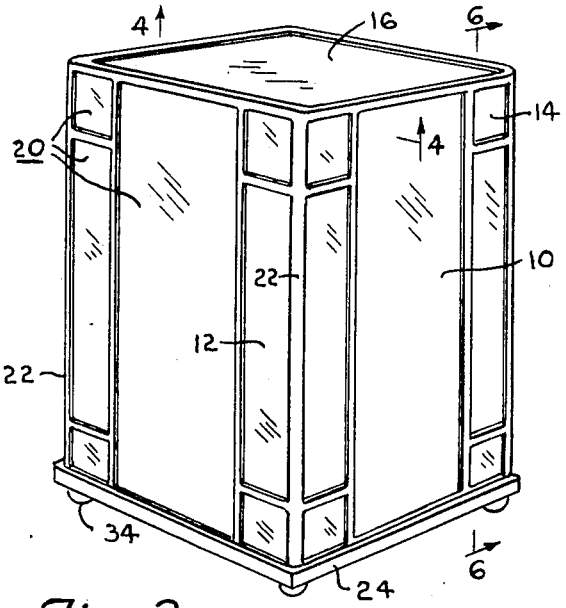
FIG. 2 is also a perspective view similar to FIG. 1 taken from a different angle.

The cremation urns can be of any desired shape, such as rectangular as shown in FIGS. 1 and 2, or they can be hexaginal, square, round or any other desired shape or combination of shapes. One typical size of cremation urn for adult usage is $5\frac{1}{4}'' \times 5\frac{1}{4}'' \times 7\frac{1}{2}''$ providing an internal capacity of approximately 200 cubic inches. They may range in size for adult usage from approximately 150 cubic inches to approximately 300 cubic inches. For children's size the urns can range from approximately $3\frac{1}{2}'' \times 3\frac{1}{2}'' \times 4\frac{1}{2}''$ providing an internal capacity of approximately 55 cubic inches. If desired double urns can be provided for husband and wife of a family. These urns, for example are a single unitary structure with a partition to divide the internal space.

In use the base 24 is removed by taking off the threaded balls 34 from the rods 26 and removing the base 24. The plastic bag that is provided is opened up and positioned inside the cardboard shield that is provided in the urn. The cremation remains are deposited in the plastic bag and it is then folded over and twist tied. The base 24 is then placed on the four threaded rods 26 which incidentally are color coded since the units are individually made and this renders it easy to be sure that the parts are assembled in the same relation. The washers 36 are then placed on the rods after the base 24 has been assembled and then the internally threaded balls 34 are applied and tightened on the rods 26. The assembled urn can then be inverted and placed in any suitable location such for example as in the niche of a crematory or at any location in the home or elsewhere as desired.

If desired the urns can be decorated with any religious or other insignia. Also a nameplate can be affixed to the urns to provide a space for recording names, dates and other significant facts.

I claim:

1. A cubical cremation urn having a plurality of side wall stained glass pieces having edge aligned surfaces, lead bonding along the edges of the stained glass pieces and having a slight convex contour at the juncture between the pieces of stained glass, a stained glass top assembled with the side wall stained glass pieces and having convex lead bonding between the side wall member and the stained glass top, a plurality of threaded rod members secured to the side wall members, a base having upper inner and lower outer surfaces, said base having apertures through which the threaded rods project, and balls threaded on the rods to clamp the base to the urn, a layer of foam on the upper inner surface of the base to prevent cremation remains from rattling, and a paper liner to prevent the cremation remains from being visible.

* * * * *